United States Patent [19]

Miller et al.

[11] 4,136,627

[45] Jan. 30, 1979

[54] APPARATUS FOR SEAMING A LID TO A CONTAINER PAN

[75] Inventors: Roland E. Miller, Orangeville; Joseph A. Scaletta, Mt. Prospect; John Valek, Cicero, all of Ill.

[73] Assignee: Kraft, Inc., Glenview, Ill.

[21] Appl. No.: 863,520

[22] Filed: Dec. 22, 1977

Related U.S. Application Data

[62] Division of Ser. No. 707,754, Jul. 22, 1976, Pat. No. 4,088,086.

[51] Int. Cl.[2] ..... B21D 19/00

[52] U.S. Cl. ..... 113/18 A; 113/1 E; 113/30

[58] Field of Search ..... 113/1 E, 7 R, 7 A, 18 R, 113/18 A, 30, 121 R, 121 A, 121 B, 121 C, 120 T, 120 V; 220/67, 77; 53/40, 42, 344, 366

[56] References Cited

U.S. PATENT DOCUMENTS

| | | | |
|---|---|---|---|
| 180,356 | 7/1876 | Marquet | 113/120 T |
| 1,422,192 | 7/1922 | Fitzsimons | 113/18 A |
| 1,647,698 | 11/1927 | Hodgson | 113/18 A |
| 2,578,734 | 12/1951 | Nordquist | 113/30 |
| 3,425,381 | 2/1969 | Wresley | 113/30 |

*Primary Examiner*—Leon Gilden

*Attorney, Agent, or Firm*—Fitch, Even, Tabin & Luedeka

[57] ABSTRACT

A method and apparatus for seaming a lid to a container pan are disclosed wherein a peripheral curled marginal edge on the lid and an outwardly directed peripheral rim on the pan are formed into a double seam by seam forming die means operative to substantially simultaneously form the seam about the full periphery of the container rather than a gradual circumferential forming of the seam as in conventional roll seaming processes.

8 Claims, 11 Drawing Figures

APPARATUS FOR SEAMING A LID TO A CONTAINER PAN

This is a division, of application Ser. No. 707,754, filed July 22, 1976 now U.S. Pat. No. 4,088,086.

The present invention relates generally to apparatus for seaming a lid to a container pan, and more particularly to a method and apparatus for securing a lid to a container pan through a hermetic double lock seam wherein the seam is simultaneously formed about the full periphery of the pan and conforms to predetermined dimensional tolerances.

In the packaging of consumer food products, and in particular food products packaged in containers which may take the form of cylindrical cans or pan type containers, the seams formed to secure the covers or lids onto the can body or container pan must conform to rigid governmental specifications and standards to insure safe packaging of the food products. More particularly, such seams must insure that the contents of the container are hermetically sealed from the surrounding atmosphere and that the seams are not susceptible to fracture or leakage during handling.

A double seam is conventionally defined as consisting of five thicknesses of material, generally three thicknesses of the lid material and two thicknesses of the pan side wall material upon which the lid is secured, the five thicknesses of material being interlocked or folded and pressed firmly together. The lid or cover is preformed with a downwardly curled edge, termed the cover hook, which may extend downwardly over the upper peripheral edge of the pan when the lid is placed thereon prior to seaming, the upper peripheral edge of the pan being formed with an outwardly directed rim portion, termed the body hook, lying in a plane substantially normal to the upstanding side walls of the pan. One known manner of seaming the complementary cover hook and body hook portions of a lid and pan is to roll tuck the curled cover hook edge of the lid so that it underlies the rim or body hook of the pan by means of rollers caused to travel the full circumference of the pan in a first operation. The seam is then completed during a second rolling operation during which rollers travel the circumference of the pan and press the seam folds downwardly in tight juxtaposition to the side wall of the pin. During formation of the seam, a compound lining or sealant which has previously been applied to the underside of the curled edge of the lid is squeezed into the spaces between the metal layers to insure a hermetic seal.

One problem which exists when forming a seam by roll forming the seam peripherally of the pan is that any irregularities in the metal thickness of the curled or hook edge of the lid and the underlying pan edge may cause a bulge in the seam which is pushed along by the rollers as the juxtaposed metal thicknesses are compressed by the rollers. This may result in an irregular or "jumped" seam or wrinkling wherein the double seam is not rolled tight enough adjacent the cross over to effect adequate interlocking.

When "loose" food products such as macaroni and chesse, ravioli, creamed chicken, beef stew, chili, etc., are packaged in metallic containers to which lids are secured by seaming, additional problems are presented. For example, when the pan portion of a container is filled with such a loose food product, the sauce frequently will not wet the interior of the container pan. When the seam is formed by conventional roll forming techniques, the pan containing the food product undergoes sufficient vibration during seaming to cause the sauce to splash up the interior wall surfaces of the container pan and across the interface of the engaging surfaces of the lid and pan before the seam can be completed, with the result that a good hermetic seal is not effected and the food product in the container may be contaminated. With the method and apparatus of forming a double seam in accordance with the present invention, the double seam is simultaneously formed about the full periphery of the pan and lid so that the contents of the container will not "crawl up" the container pan walls and across the interface of the contacting lid and pan surfaces before the seam is completed as results with gradual circumferential roll forming of the seam.

In accordance with the present invention, a method and apparatus for seaming a lid to a metallic container pan are provided wherein a depending curled marginal edge or cover hook on the lid and a peripheral rim or body hook on the pan are formed into a hermetic double seam by seam forming die means operative to simultaneously form the seam about the full periphery of the container rather than through a gradual circumferential forming of the seam as in roll forming the seam. A first die means is movable in a direction substantially normal to the plane of the depending marginal edge or cover hook of the lid to engage the cover hook edge and form it into underlying juxtaposition to the body hook edge of the pan. The juxtaposed peripheral edges of the lid and pan are then formed downwardly by second die means movable in normal relation to the plane of the body hook so that the outer marginal edge of the lid lies against the outer surface of the adjacent upstanding pan wall so as to establish a double seam comprised of five juxtaposed thicknesses of the lid and pan at the seam, whereafter the second die means is cammed in a direction normal to the pan wall to compress the thicknesses of seam material together. In accordance with the apparatus of the invention, the lid is uniformly seamed to the container pan circumferentially of the pan so that the dimensional tolerances of the seam are consistent and positively maintained, thereby establishing a substantial advantage over roll seaming techniques.

According, it is one of the primary objects of the present invention to provide a novel apparatus for seaming a lid to a container pan which assures consistent hermetic seam formation within desired dimensional limitations.

Another object of the present invention is to provide a system for securing a lid to a container pan through a double lock seam, which system employs first and second seam forming die means which are caused to undergo positive controlled movement so as to provide predetermined dimensional control of the final seam.

A feature of the present invention lies in the provision of seam forming dies for simultaneously forming a double lock seam about the full periphery of a lid and associated container pan without having to move the forming dies circumferentially about the container pan as has heretofore been necessary with seam forming rollers.

Further objects and advantages of the present invention, together with the organization and manner of operation thereof, will become apparent from the following detailed description of the invention when taken in conjunction with the accompanying drawings wherein like reference numerals designate like elements throughout the several views, and wherein.

Figure 1:
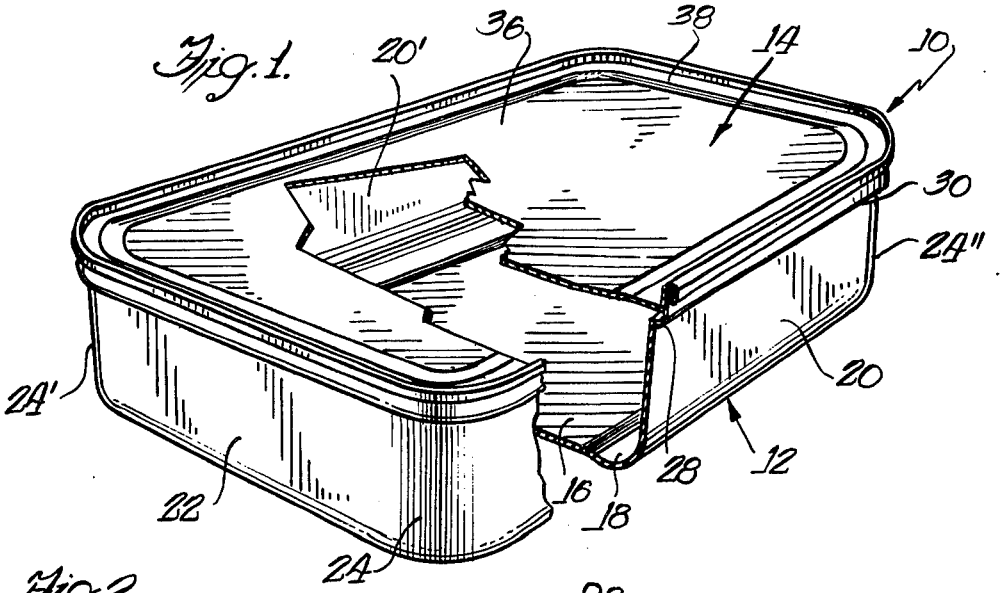
FIG. 1 is a perspective view of a container pan having a lid secured thereon in accordance with the apparatus of the present invention, portions being broken away for clarity.
Figure 2:
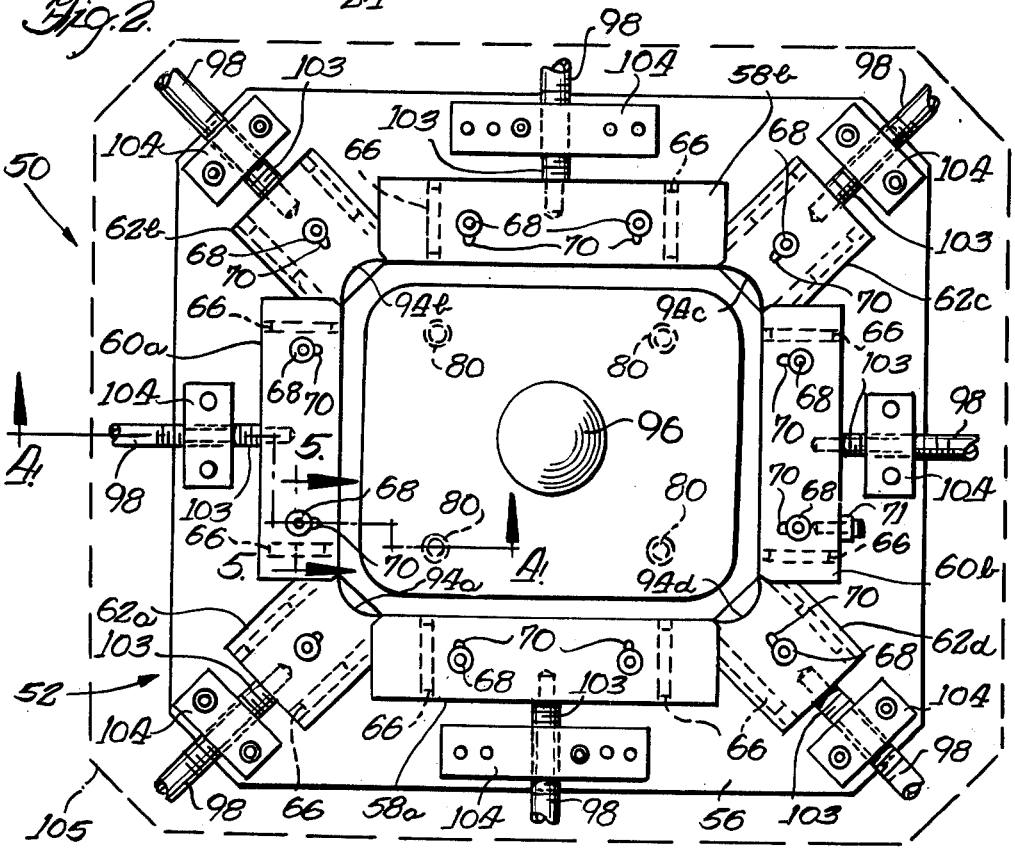
FIG. 2 is a plan view of the lower die fixture portion of a first die employed in securing the lid to the container pan of FIG. 1.
Figure 5:
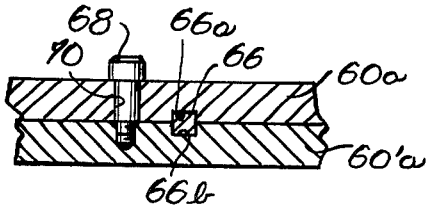
Figure 3:
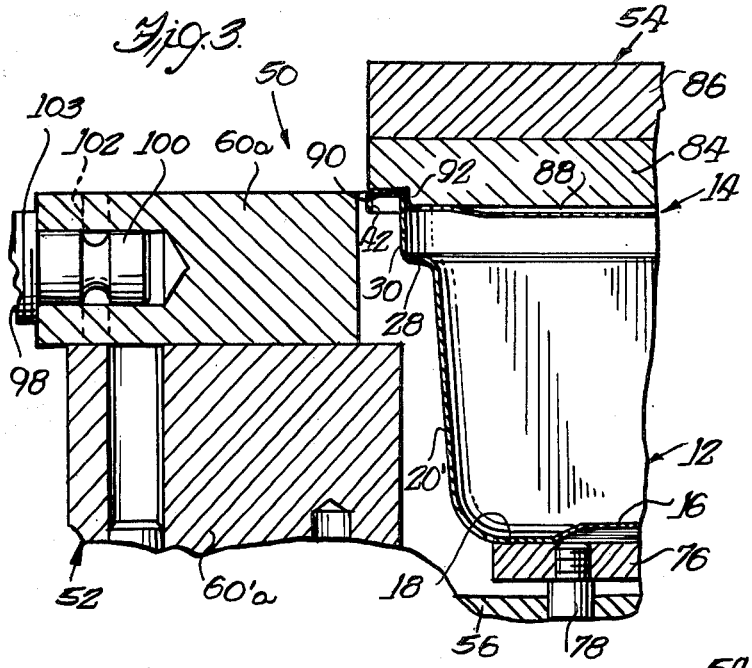
FIG. 3 is an enlarged partial transverse sectional view of the lower die fixture of FIG. 2 shown in cooperation with an upper retainer die preparatory to forming the cover hook of the lid into underlying juxtaposed relation with the body hook on the pan.
Figure 3A:
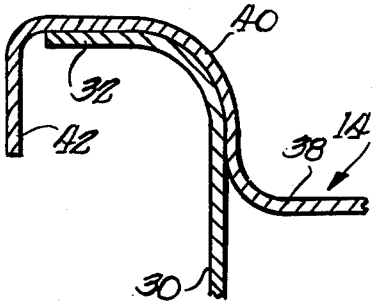
Figure 4:
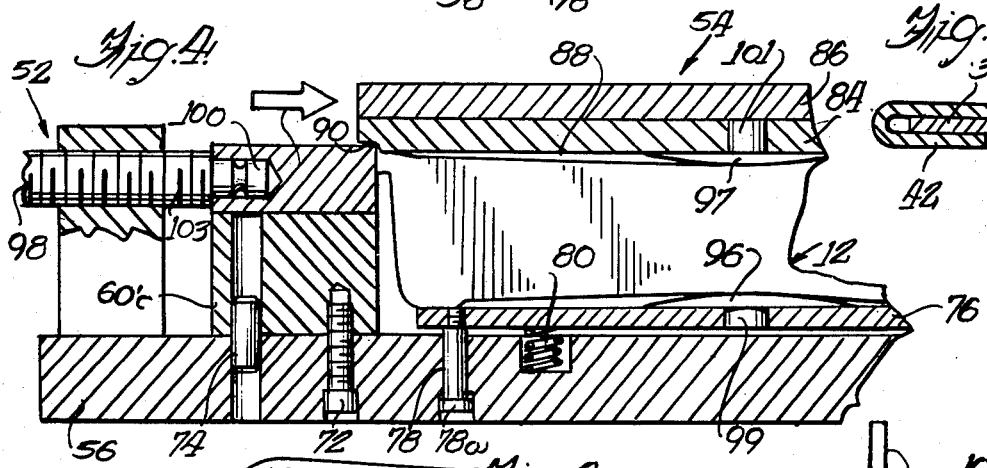
Figure 4A:
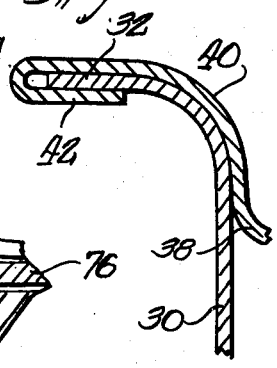
Figure 6:
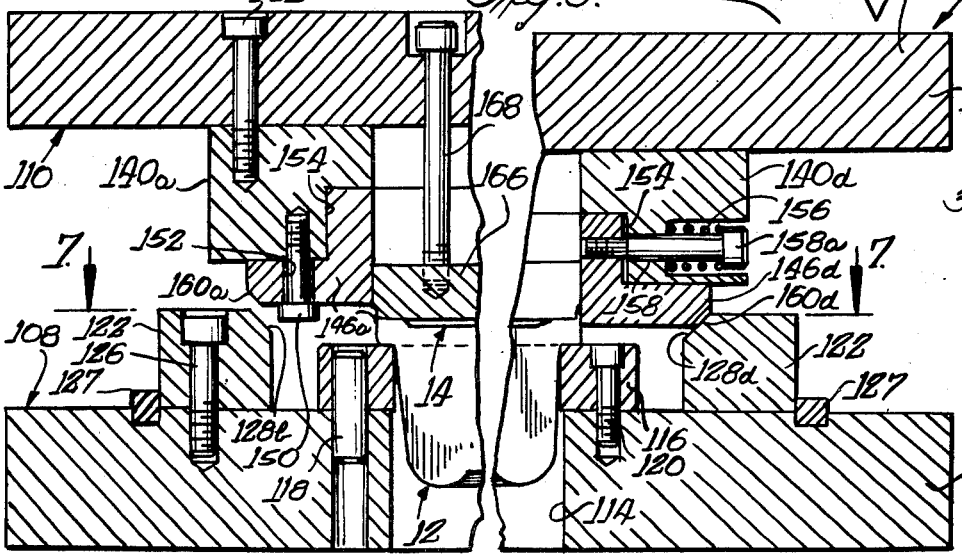
Figure 6A:
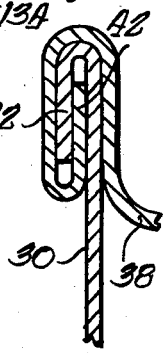
Figure 7:
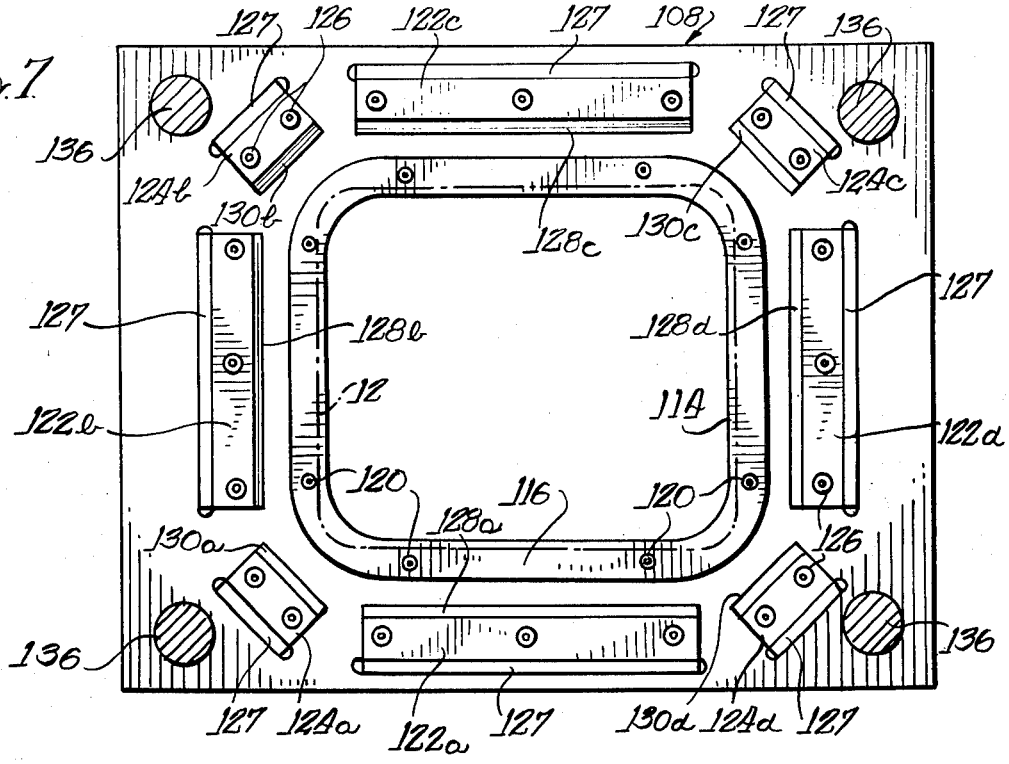
Figure 8:
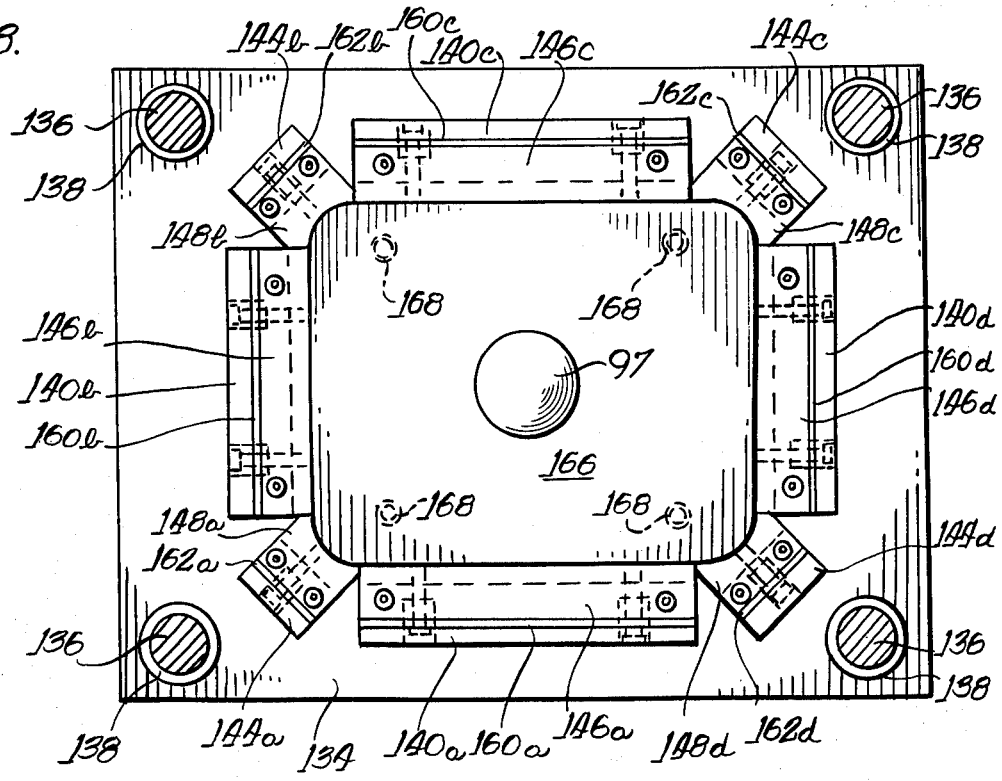

FIG. 3*a* is an enlarged partial sectional view illustrating the manner in which the lid is received on the pan preparatory to forming double lock seam;

FIG. 4 is an enlarged partial transverse sectional view similar to FIG. 3 but showing the elements of the lower die fixture after forming the cover hook on the lid into underlying juxtaposed relation to the body hook on the pan;

FIG. 4*a* is an enlarged partial sectional view showing the lid and pan after partially forming the seam as in FIG. 4;

FIG. 5 is a partial sectional view taken along the line 5—5 of FIG. 2 to show a typical guide rail and guide bolt for the seam forming plates;

FIG. 6 is a foreshortened transverse sectional view of a second die for completing the double seam between the lid and pan of FIG. 1, the left-hand portion of FIG. 6 showing the die elements prior to completing the seam and the right-hand portion of FIG. 6 showing the die elements after completion of the seam;

FIG. 6*a* is an enlarged partial sectional view showing the completed double seam between the lid and pan of the container of FIG. 1;

FIG. 7 is a plan view of the lower portion of the seam forming die of FIG. 6, taken substantially along the line 7—7 of FIG. 6 and looking in the direction of the arrows, a pan being shown in phantom supported in the lower die portion; and FIG. 8 is a bottom view of the upper portion of the seam forming die of FIG. 6.

Referring now to the drawings, and in particular to FIG. 1, a container having a double seam formed in accordance with the apparatus of the present invention is indicated generally at 10. The container 10 is rectangular in configuration and includes a lower pan portion, indicated generally at 12, and an upper lid portion, indicated generally at 14. The pan 12 has a planar bottom surface 16 the outer peripheral edge of which is formed into a downwardly concave trough 18. The pan 12 includes upstanding side walls in the form of longitudinal side walls 20 and 20' and transverse end walls one of which is indicated at 22. In a preferred embodiment, the upstanding side walls of the pan 12 are formed integral with the bottom 16 and are integrally interconnected through smooth radially rounded corner walls, three of which are shown at 24, 24', and 24''.

The upstanding side walls and smooth corner walls of the pan 12 are inclined slightly outwardly from vertical relative to the bottom 16 and terminate at their upper edges in a peripherally continuous horizontal shelf or step 28 which is formed integral at its outer marginal edge with a vertically disposed rim or rise 30. The uppermost marginal edge of the peripherally extending rim 30 is formed with an outwardly directed flange 32 (FIG. 3*a*) which lies in a plane substantially perpendicular to the peripheral wall or rim 30 and becomes the body hook of the completed seam.

The flange 32 on the pan 12 serves to receive the lid 14 thereon and form a portion of the double lock seam securing the lid to the container pan to hermetically seal the lid onto the pan. To this end the lid 14 includes a central planar portion 36 and a peripheral planar surface 38 which may lie in a plane parallel to but spaced upwardly from the plane of the central portion 36. The outer marginal edge of the peripheral surface 38 is formed with a precurled cover hook 40 having a transverse curvature similar to the transverse curvature of the body hook portion 32 on the pan 12, as shown in FIG. 3*a*, so that the cover hook effects surface engagement with the body hook 32 when disposed thereon. The outer peripheral edge of the cover hook 40 on the lid 14 is formed into a depending lip 42 the plane of which is substantially perpendicular to the plane of the lid surface 38.

The container 10 is shown as a rectangular container to illustrate one embodiment of a container which has a lid secured thereon in accordance with the present invention. The container 10 illustrated in FIG. 1 has a longitudinal length of approximately 12 inches, a transverse width of approximately 10 inches, and a vertical depth of approximately 2¼ inches. A container of this size may readily accommodate approximately 106 oz. of a food product such as macaroni and cheese. The particular size of the container 10 and the intended products to be packaged therein do not limit the present invention, it being appreciated that containers of larger or smaller size may have lids secured thereon in accordance with the present invention.

As noted, conventional methods for securing a lid to a container pan by forming a double lock seam employ seam forming rollers which are caused to travel the full circumference of the container during formation of the seam. With the pan 12 having a lid 14 disposed thereon as partially shown in FIG. 3*a*, the present invention is directed to die means for simultaneously effecting a hermetic double seal about the full periphery of the lid and pan. To this end, and with reference to FIGS. 2–4, a first die means, indicated generally at 50, is shown for forming the depending edge or lip portion 42 of the cover hook 40 on the lid 14 into underlying juxtaposed relation to the outwardly directed flange or body hook portion 32 of the pan 12.

The first die means 50 includes a lower die fixture, indicated generally at 52, and an upper retainer die, indicated generally at 54. The lower die fixture 52 includes a base plate 56 upon which are mounted four side seam forming plates 58*a*, 58*b*, 60*a* and 60*b* and four indentically shaped corner seam forming plates 62*a*, 62*b*, 62*c* and 62*d*. The side seam forming plates 58*a*, *b*, and 60*a*, *b*, and the corner seam forming plates 62*a–d* are each supported on a corresponding support or riser block such as shown at 60'*a* for the side seam forming plate 60*a* in FIGS. 3 and 4. Noting FIG. 2, the side seam forming plates 58*a*, *b*, and 60*a*, *b* are supported in opposed pairs so that the longitudinal axes of the side seam forming plates of one pair are parallel and intersect the longitudinal axes of the other pair of opposed side seam forming plates at 90° angles. The corner seam forming plates 62*a*, *b*, *c* and *d* and their associated riser blocks are supported so that their longitudinal axes intersect the longitudinal axes of the adjacent side seam forming plates at 45° angles.

The side and corner seam forming plates 58*a, b,* 60*a, b* and 62*a–d* are supported for rectilinear movement parallel to the base plate 56, the side seam forming plates being movable in a direction transverse to their longitudinal axes while the corner seam forming plates are movable in the direction of their longitudinal axes. To this end, each of the side end corner seam forming plates is interconnected to its associated riser block through a pair of parallel spaced guide rails 66 as shown in FIGS. 2 and 5. The guide rails 66 may be square in cross section and are received within correspondingly shaped channels formed with complementary portions in the opposed sliding surfaces of the seam forming plates and their associated riser blocks, such as exemplified by the complementary channels 66*a* and 66*b* formed, respectively, in the seam forming plate 60*a* and underlying riser block 60'*a* shown in FIG. 5. The side seam forming plates 58*a, b* and 60*a, b* and the corner seam forming plates 62*a–d* are retained on their respective riser blocks by suitable cap screws, such as indicated at 68, which are received through elongated slots 70 in the respective side and corner seam forming plates and are threadedly secured to the associated riser blocks. The elongated slots 70 may be of predetermined length to limit inward movement of the seam forming plates. Alternatively, stop members, such as indicated at 71 in FIG. 2, may be mounted on the seam forming plates to limit inward movement thereof by abutment with the associated riser blocks. The riser blocks, such as 60'*a*, are affixed to the base plate 56 by suitable means such as screws 72 and locating pins 74 as shown in FIG. 4.

With reference to FIG. 2, it can be seen that the side seam forming plates 58*a,* 58*b,* 60*a* and 60*b* and the corner seam forming plates 62*a–d* are supported on the base plate 56 in a manner to define a substantially rectangular opening therebetween. A rectangular lifter plate 76 is supported on the base plate 56 within the opening defined by the side and corner seam forming plates. The lifter plate 76 is mounted on the base plate 56 for limited upward and downward movement relative to the base plate through four guide screws, one of which is shown at 78 in FIGS. 3 and 4. A coil compression spring 80 is interposed between the lifter plate 76 and the base plate 56 proximate each of the guide screws 78 so as to bias the lifter plate 76 to its uppermost position relative to the base plate 56. The lifter plate 76 serves to assist in ejecting a container pan 12 after securing a lid 14 thereon.

The opening defined by the side and corner seam forming plates 58*a, b,* 60*a, b* and 62*a–d* and their associated riser blocks is of sufficient size to receive a pan 12 and associated lid 14 preparatory to securing the lid on the pan, with the lower surface of the peripheral trough 18 resting on the lifter plate 76. With a pan 12 and lid 14 disposed on the lifter plate 76 preparatory to seaming, the upper retainer die 54 is moved downwardly a predetermined distance such that a pilot plate 84 engages the peripheral surface 38 on the lid 14 and firmly positions the lid and pan against the lifter plate. The pilot plate 84 is affixed to a top support plate 86 which, in turn, may be suitably affixed to the vertically movable ram of a conventional forming press (not shown) having conventional control means operative to effect selective vertical movement of the pilot plate 84 relative to the lower die fixture 52. The pilot plate 84 has a lower pilot surface 88 adapted to engage the peripheral surface 38 on the lid 14 and has a peripheral recess 90 and adjacent shoulder surface 92 which engage the cover hook surface 40 on the lid to locate the lid and associated pan 12 relative to the side and corner seam forming plates.

The side and corner seam forming plates 58*a,* 58*b,* 60*a,* 60*b* and 62*a–d* are of a height such that movement thereof toward the pan 12 and associated lid 14 will effect abutment of the seam forming plates against the depending peripheral lip 42 on the lid. Continued inward movement of the side and corner seam forming plates serves to form the depending lip 42 into underlying juxtaposed relation to the body hook 32 on the upstanding rim 30 of the pan 12. Because the mating corners of the pan and lid are rounded, as shown in FIG. 1, the corner seam forming plates 62*a–d* are provided with radial concave forming surfaces 94*a–d*, respectively, which conform to the curvatures of the corners of the lip 42 on the lid 14 and are operative to engage the corners of the lip and form the lip under the body hook 32 of the pan when moved sufficiently inwardly.

To effect inward and outward movement of the side and corner forming plates 58*a, b,* 60*a, b* and 62*a–d* relative to the lip 42 on the lid 14, each of the forming plates has a control rod 98 connected thereto. To this end, each of the control rods 98 has a reduced inner end 100 rotatably retained within a suitable bore in the associated seam forming plate by a retaining pin 102 (FIG. 3) cooperable with an annular groove in the control rod. The control rods 98 may be actuated by any suitable means to effect simultaneous movement of the side and corner seam forming plates relative to the lip 42 on the lid 14. In the illustrated embodiment, the control rods 98 are threaded along their lengths at 103 and are received through suitable complementary threaded bores in support blocks 104 such that simultaneous rotation of the control rods through conventional mechanical or electrical connection, as indicated schematically by the dash line 105, will effect simultaneous movement of the seam forming plates relative to the depending lip 42 on the lid 14 to form the lip 42 in underlying juxtaposed relation to the body hook 32 on the pan 12, as shown in FIGS. 4 and 4*a*, whereafter the seam forming plates are retracted to positions as shown in FIG. 3. During this initial step in forming the double lock seam, the lifter plate 76 and pilot plate 84 compress the bottom of the pan 12 and the lid 14 to physically remove a substantial portion of any air within the pan.

To facilitate compression of the bottom 16 of the pan 12 and the central portion 36 of the lid 14 toward each other to remove air from the space above the product within the pan during the initial step of forming the lip 42 into underlying juxtaposed relation to the flange 32 on the container pan, the lifter plate 76 and pilot plate 84 have pressure pads or bumpers 96 and 97, respectively, releasably secured centrally to their exposed inner surfaces. The pressure pads 96 and 97 may comprise circular convex shaped bumpers made of a suitable material, such as relatively hard rubber, and mounted on the lifter plate 76 and pilot plate 84 through support shafts 99 and 101, respectively, which are releasably secured within suitable openings in the lifter plate and pilot plate. The pressure pads 96 and 97 are operative to engage the bottom 16 of the pan and upper lid 14 generally centrally thereof to compress the lid and bottom of the pan toward each other and displace a selected amount of the air disposed between the lid and product within the pan during seaming.

By removing a substantial amount of the air "head" within the container pan underlying the lid 14 during hermetic securing of the lid to the pan, subsequent fermentation of the food product will create internal gas pressure causing the lid to noticeably bulge. The noticeable bulge is readily visually detected and thus provides a signal that the product within the container may be spoiled or otherwise unsuitable for its intended use. When packaging cold food products within the container 10, both of the pressure pads 96 and 97 are provided on the lifter plate 76 and pilot plate 84, respectively, as described. When packaging hot products within the containers 10, the pressure pad 97 on the upper pilot 84 need only be employed.

After the depending lip 42 on the lid 14 has been formed to underlie the body hook 32 of the pan 12 in juxtaposed relation therewith, the ram of the press (not shown) is raised to remove the pilot plate 84 from the lid 14 whereafter the lifter plate 76 will raise the pan and associated lid upwardly under the influence of the springs 80 to allow removal of the pan and partially seamed lid. The pan and associated lid are then moved to second die means, indicated generally at 106 in FIG. 6, for completing the double seam.

The second die means 106 includes a lower die set, indicated generally at 108, and an upper final seam forming die, indicated at 110. With reference to FIGS. 6 and 7, the lower die set 108 is adapted to receive the pan 12 and associated lid 14 therein after having formed the cover hook 42 on the lid into underlying juxtaposed relation to the body hook 32 on the pan as shown in FIG. 4*a*, preparatory to completing the double seam between the lid and pan. The lower die set 108 includes a support plate 112 having a central rectangular opening 114 therethrough of a size sufficient to receive the pan 12 therein. A yoke member 116 is mounted on the support plate 112 through locating pins 118 and screws 120 and extends around the periphery of the opening 114 so as to underlie the shelf 28 of the pan 23 and positively locate the pan relative to the support plate 112. Four side cam blocks 122*a*, 122*b*, 122*c*, and 122*d* and four corner die blocks 124*a*, 124*b*, 124*c* and 124*d* are mounted on the support plate 112 through mounting screws 126. The side cam blocks 122*a–d* and corner cam blocks 124*a–d* are spaced outwardly from the yoke 116 and extend generally peripherally thereabout as shown in FIG. 7. Preferably, a locating bar or key 127 is received within a complementary channel in the support plate 112 rearwardly of each of the side and corner cam blocks 122*a–d* and 124*a–d* to provide positive stops for the cam blocks. Each of the side cam blocks 122*a–d* has a cam surface 128*a–d*, respectively, formed thereon, while each of the corner cam blocks 124*a–d* has a cam surface 130*a–d*, respectively, formed thereon the purpose of which will be described hereinafter.

The upper final seam forming die 110 includes a mounting plate 134 which is vertically aligned with the lower support plate 112 through four guide rods 136 each of which is secured in normal relation to the support plate 112 adjacent a corner thereof and is received upwardly through an axially aligned guide sleeve 138 received within a suitable bore in the mounting plate 134 to allow relative movement between the plates 112 and 134. The lower die set 108 and upper final seam forming die 110 are mounted within a conventional forming press (not shown) so that the mounting plate 134 and support plate 112 may be moved toward and away from each other upon controlled movement of the ram of the press.

A plurality of riser blocks 140*a*, 140*b*, 140*c* and 140*d* are fixedly mounted on the lower surface of the mounting plate 134 through mounting screws 142 so as to form opposite pairs of riser blocks as shown in FIG. 8. Four corner riser blocks 144*a*, 144*b*, 144*c* and 144*d* are also mounted on the mounting plate 134 interposed between the riser blocks 140*a–d* and have the same vertical height as the riser blocks 140*a–d*. The riser blocks 140*a–d* support side seam forming dies 146*a*, 146*b*, 146*c* and 146*d*, respectively, while the corner riser blocks 144*a–d* support corner seam forming dies 148*a–d*, respectively. With FIG. 6 being representative of the manner in which the side and corner seam forming dies 146*a–d* and 148*a–d* are mounted on their respective riser blocks, it can be seen that each seam forming die is attached to its associated riser block through a support screw 150 which is threadedly secured to the associated riser block and is received through an elongated slot 152 in the seam forming die to allow horizontal movement of the seam forming dies. Each of the seam forming dies is generally L-shaped in transverse cross section and is biased against a complementary surface on the associated riser block, such as indicated at 154 in FIG. 6, by means of a coil compression spring 156 disposed between the riser block and the head 158*a* of a screw 158 threadedly secured to the seam forming die as shown. With reference to FIG. 8, it can be seen that the side seam forming dies 146*a–d* each have a pair of parallel spaced screws 158 secured thereto with associated biasing springs 156, while the corner seam forming dies 148*a–d* have only one guide screw 158 and associated biasing springs associated therewith.

The side and corner seam forming dies 146*a–d* and 148*a–d* have cam surfaces 160*a–d* and 162*a–d*, respectively, formed thereon which are cooperable with the cam surfaces 128*a–d* and 130*a–d* on the lower side corner cam blocks 122*a–d* and 124*a–d*, respectively, to effect inward movement of the seam forming dies when the mounting plate 134 is moved a predetermined distance toward the support plate 112, as will be described below.

A pilot plate 166 is supported on the mounting plate 134 through a plurality of support screws, one of which is indicated at 168 in FIG. 6, so that the pilot plate may move vertically relative to the mounting plate. The pilot plate is normally biased downwardly by its own weight to a position as shown in the left-hand portion of FIG. 6. The pilot plate 166 has a lower surface contour adapted to engage the planar peripheral surface 38 and a portion of the cover hook surface 40 on the lid 14 when the mounting plate 134 is moved downwardly to a position as shown in the left-hand portion of FIG. 6 so that the pilot plate maintains the lid and associated pan in relatively fixed position within the yoke 116. Preferably, a pressure pad 170 (FIG. 8), which is similar to the aforedescribed pressure pads 96 and 97, is releasably mounted on the lower central surface of the pilot plate 66 to engage and depress the lid 14 in a similar manner to the pressure pad 97 during completion of the double lock seaming.

To complete the double lock seam between the lid 14 and pan 12 after the cover hook 42 and body hook 32 are formed as in FIG. 4*a*, the pan and associated lid are placed within the yoke 116 on the support plate 112 while the mounting plate 34 is raised above the lower die set 108. The mounting plate 134 is then moved downwardly to effect engagement of the pilot plate 166 with the lid 14 as shown in the left-hand portion of FIG. 6. Further downward movement of the mounting plate 134 causes the seam forming dies 146*a–d* and 148*a–d* to engage and form the generally horizontally disposed body hook 32 of pan 12 and the underlying juxtaposed cover hook 42 of the lid 14 to a position wherein the cover hook 42 lies against the upstanding rim 30 of the pan 12, as shown in FIG. 6*a*.

Continued downward movement of the mounting plate 134 effects engagement of the cam surfaces 160*a–d* and 162*a–d* on the side and corner seam forming dies with the underlying cam surfaces 128*a–d* and 130*a–d* on the cam blocks 122*a–d* and 124*a–d*, respectively, so as to move the seam forming dies horizontally or in a direction perpendicular to the plane of the upstanding rim 30 on the pan 12 whereby to firmly compress the juxtaposed edges forming the seam to simultaneously complete the double seam about the full periphery of the container 10. Preferably, a sealing compound compatible with the food product within the pan 12 is applied to the under surface of the cover area 40 on the lid 14 prior to forming the double lock seam so that the sealant flows into any spaces internally of the seam. Upon completing the double lock seam between the lid 14 and pan 12 of the container 10, the mounting plate 134 is raised from the support plate 112 sufficiently to allow removal of the completed pan.

Thus, in accordance with the apparatus of the present invention for securing a lid to a container pan by seaming, a double lock seam is formed simultaneously about the full periphery of the container. As a result, the vibrations generally attendant with conventional roll seaming methods wherein rollers are caused to gradually travel the full circumference of the container are eliminated. This is particularly important with metallic containers wherein the sauces of loose or flowable food products may splash up the sides of the containers and across the interface of the engaging lid and pan seam surfaces prior to completion of the seam due to vibration of the container pan caused by the moving seam roller, with the result that contamination of the food product may result or an incomplete nonhermetic seam may be formed.

While a preferred embodiment of the present invention has been illustrated and described, it will be obvious that changes and modifications may be made therein without departing from the invention in its broader aspects. For example, while the illustrated embodiment of the apparatus for securing the lid 14 to the container pan 12 has been described in conjunction with the rectangular pan 12 and lid 14, the apparatus could be modified to secure a nonrectangular shaped lid to a complementary shaped container pan, the lid and pan having marginal peripheral edges formed to define a cover hook or depending lip and a body hook or peripheral flange surface, respectively. Various features of the invention are defined in the following claims.

What is claimed is:

1. A system for securing a lid to a container pan wherein the lid has a peripheral marginal surface the outer marginal edge of which is formed into a depending lip, and wherein the pan has an upstanding wall the upper edge of which forms an outwardly directed flange which lies in a plane substantially perpendicular to said upstanding wall, said lid being disposed on said pan with said marginal surface overlying said flange and with said depending lip disposed outwardly of and extending below the plane of said flange, said system comprising, first die means including a die fixture adapted to receive and support said pan and complementary lid, said first die means further including seam forming plate means supported peripherally of said pan and lid and movable in a plane substantially perpendicular to said depending lip on said lid, and means operatively associated with said forming plate means to effect movement thereof so as to engage said depending lip and form it into underlying juxtaposed relation to said flange, and second die means including a lower die set adapted to receive and support said pan and rim after forming said lip into said underlying juxtaposed relation to said flange, said second die means including final seam forming supported for movement in a first direction substantially perpendicular to said outwardly directed flange and for subsequent movement in a second direction substantially perpendicular to said upstanding wall of said pan, and means for effecting said movements of said seam forming die means to, firstly, form said flange and juxtaposed lip against said upstanding wall, and, secondly, press the juxtaposed thicknesses of said flange, marginal surface of said lid, and said lip against said upstanding wall to complete said double seam.

2. A system as defined in claim 1 wherein said pan and associated lid include substantially straight side edges and rounded corner edges, and wherein said seam forming plates include side seam forming plates juxtaposed to said side edges of said pan when supported on said pan support means, and corner seam forming plates juxtaposed to said rounded corner edges.

3. The system of claim 1 wherein said first die means includes pan support means having a lift plate adapted to receive said pan thereon, and pilot plate means adapted to engage the outer surface of said lid and position said pan against said lift plate.

4. The system of claim 3 wherein said lift plate means includes means biasing said lift plate toward said pilot plate so as to place a lid and pan interposed therebetween in a state of compression.

5. The system as defined in claim 1 wherein said second die means includes pan support means adapted to support a pan and associated lid after said depending lip on said lid is formed into juxtaposed underlying relation with said flange, said final seam forming die means including a plurality of seam forming dies extending peripherally of a pan and associated lid when supported on said pan support means, said seam forming dies being movable in said direction substantially normal to said flange to engage said flange and underlying juxtaposed lip and effect said forming thereof to positions wherein said underlying lip lies against said upstanding wall of said pan, said seam forming dies being further movable in said direction substantially normal to said upstanding wall of said pan to press said juxtaposed thicknesses against said upstanding wall to complete said double seam.

6. The system as defined in claim 5 including cam block means supported by said pan support means of said second die means for cooperation with said seam forming dies to effect movement thereof in said second direction after said forming die means is moved in said first direction a predetermined distance.

7. The system as defined in claim 6 wherein said second die means includes pilot plate means adapted to engage said lid when its associated pan is disposed on said pan support means, said pilot plate means serving to position said lid and pan against said pan support means.

8. The system as defined in claim 1 wherein said first die means includes means for compressing the bottom of said pan and said lid toward each other to remove air from said pan during forming of said depending lip into underlying juxtaposed relation to said flange.

* * * * *

UNITED STATES PATENT AND TRADEMARK OFFICE

CERTIFICATE OF CORRECTION

PATENT NO. : 4,136,627

DATED : January 30, 1979

INVENTOR(S) : Roland E. Miller et al.

It is certified that error appears in the above-identified patent and that said Letters Patent are hereby corrected as shown below:

Col. 1, line 46, "pin" should be --pan--.

Col. 9, line 41, "seam" should be --seal--.

Col. 10, lines 11-12, after "forming" insert --die means--.

Signed and Sealed this

*Sixth* Day of *November 1979*

[SEAL]

*Attest:*

RUTH C. MASON
*Attesting Officer*

LUTRELLE F. PARKER
*Acting Commissioner of Patents and Trademarks*